US005558552A

United States Patent [19]

Namur

[11] Patent Number: 5,558,552

[45] Date of Patent: Sep. 24, 1996

[54] FASTENING FOR THE FOOT-LOOP STRAPS OF SURFBOARDS

[75] Inventor: Marc Namur, Weiterstadt, Germany

[73] Assignee: Fanatic Sports GmbH, Ransbach-Baumbach, Germany

[21] Appl. No.: 521,844

[22] Filed: Aug. 31, 1995

[30] Foreign Application Priority Data

Aug. 31, 1994 [DE] Germany ..... 9413936 U

[51] Int. Cl.[6] ..... A63C 15/06

[52] U.S. Cl. ..... 441/75; 280/611; 441/70

[58] Field of Search ..... 441/70, 74, 75, 441/39.2; 280/611

[56] References Cited

U.S. PATENT DOCUMENTS

| | | | |
|---|---|---|---|
| 3,900,204 | 8/1975 | Weber | 441/70 |
| 4,604,070 | 8/1986 | McKee et al. | 441/75 |
| 5,018,468 | 5/1991 | Peterson | 441/75 |

FOREIGN PATENT DOCUMENTS

| | | | |
|---|---|---|---|
| 0117624 | 9/1984 | European Pat. Off. . | |
| 3230464 | 3/1984 | Germany | 441/75 |
| 8909535.9 | 11/1989 | Germany . | |

*Primary Examiner*—Jesus D. Sotelo
*Attorney, Agent, or Firm*—Young & Thompson

[57] ABSTRACT

The fastening for foot-loop straps of surfboards has fastening bars (6) placed on the board upper side in the board body at intervals, location holes (36) at equal intervals with an insertion slot (37), an undercut (38), and an upper side positioning nut (39) for the insertion of locking bars (40) each with a swivelling handle (41). The locking bars (40) are positioned so they can turn in fastening plates (42) and have a locking bar nose (44) matching the insertion slot (37) of the bores (36) in the fastening bars (6). By turning the locking bar (40), which is placed in a location hole (36) of the fastening bars (6) corresponding to one of the desired positions chosen for the foot-loop straps, the locking bar (40) interfits with the nose of the locking bar (44) like a bayonet catch with the undercut (38) of the location hole (36). The foot-loop straps can be fastened in the desired position on the surfboard and removed from the surfboard simply and quickly without using tools.

6 Claims, 4 Drawing Sheets

FASTENING FOR THE FOOT-LOOP STRAPS OF SURFBOARDS

The invention concerns a fastening for the foot-loop straps of surfboards.

The different uses of the surfboard and the different capabilities of surfers require an adjustability of surfboard fins, mast foot, and foot-loop straps.

Up to now foot-loop straps of, for example, the type known in DE 89 09 535.9 U1 were screwed down in the most favorable position for the surfer on the holding strip, which is inserted in the upper side of the surfboard.

Screwing the foot-loop straps down on the surfboard requires tools and is relatively time-consuming. In addition, a danger exists that the fastening screws will loosen in time and the foot-loop straps will get lost.

The object of the invention is to provide a safer foot-loop strap fastening for surfboards that makes possible easy and quick fastening of the foot-loop strap to the surfboard and removal from the surfboard without using tools.

The foot-loop strap fastening according to the invention is distinguished by the advantages that can be inferred from the object.

Figure 1:
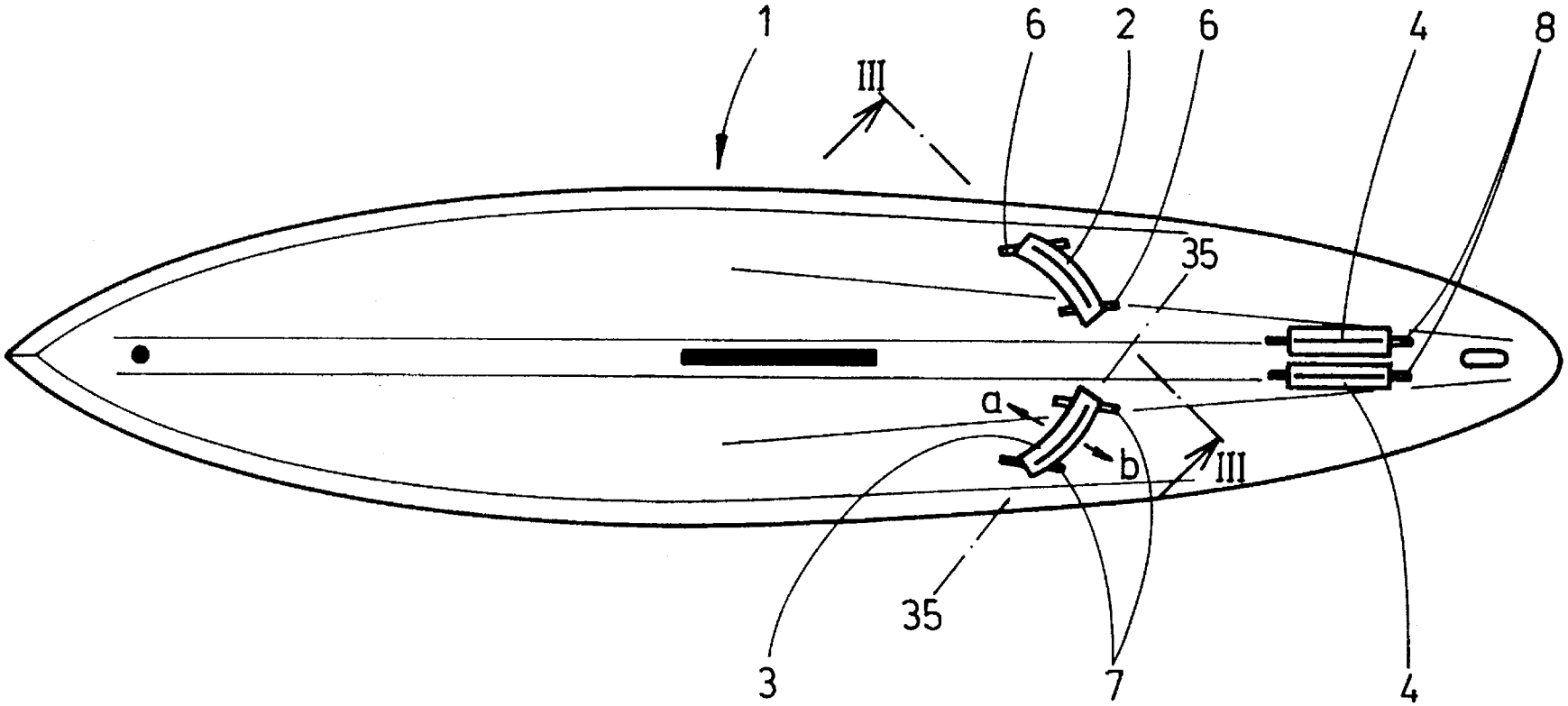
Figure 2C:
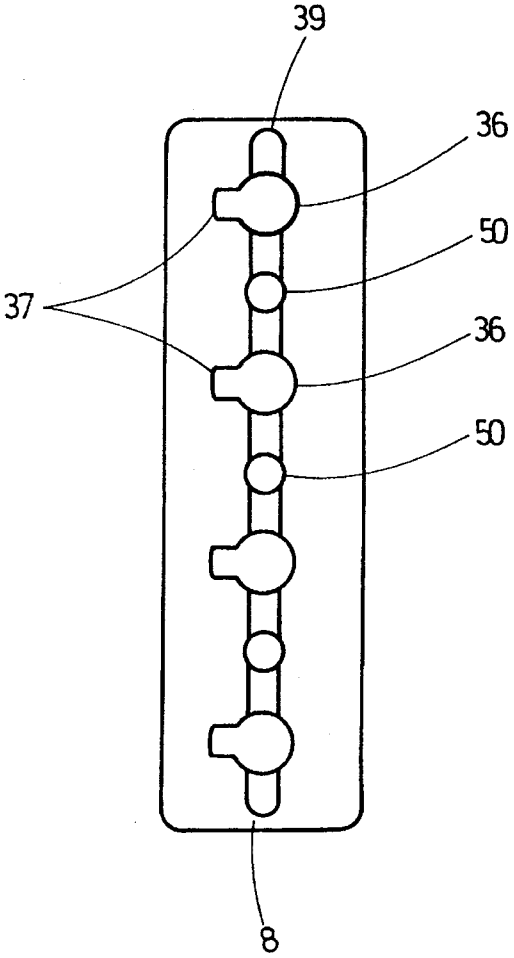
Figure 2B:
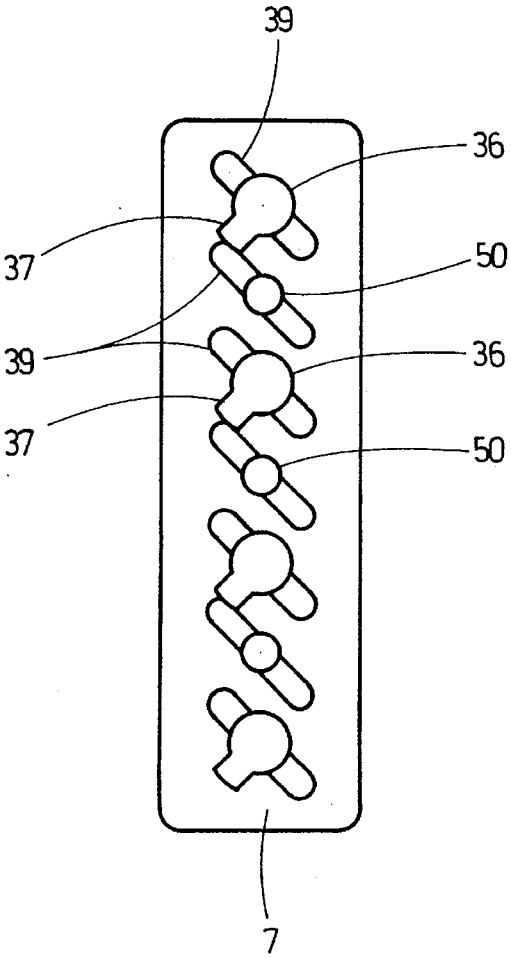
Figure 2A:
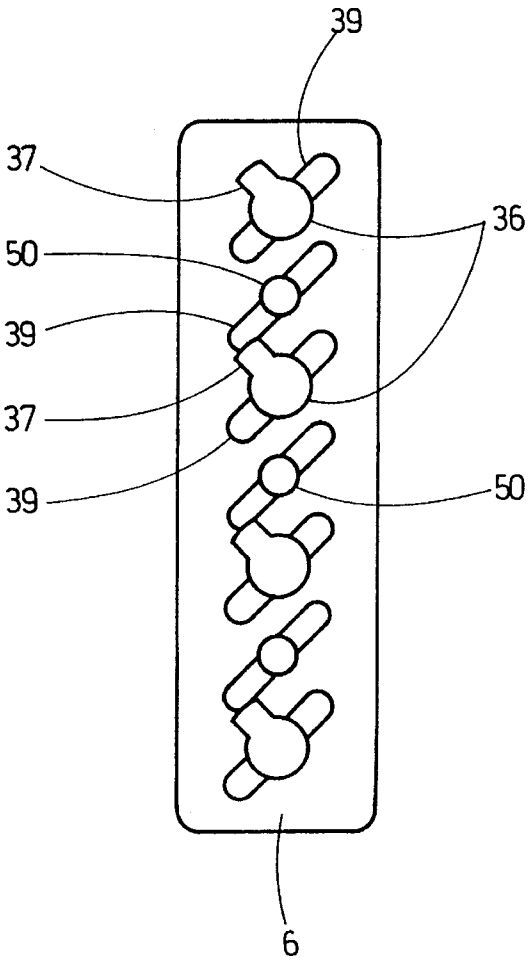
Figure 3:
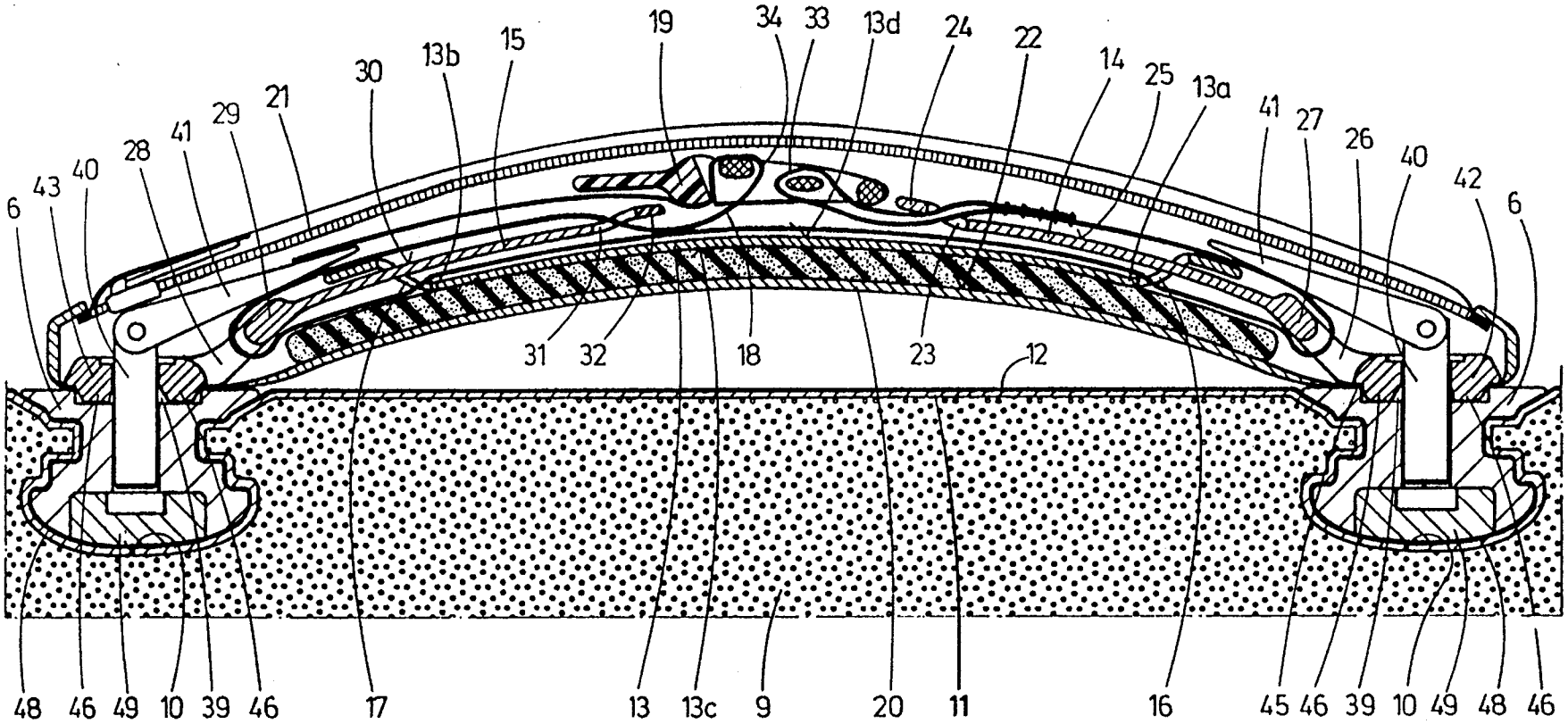
Figure 4:
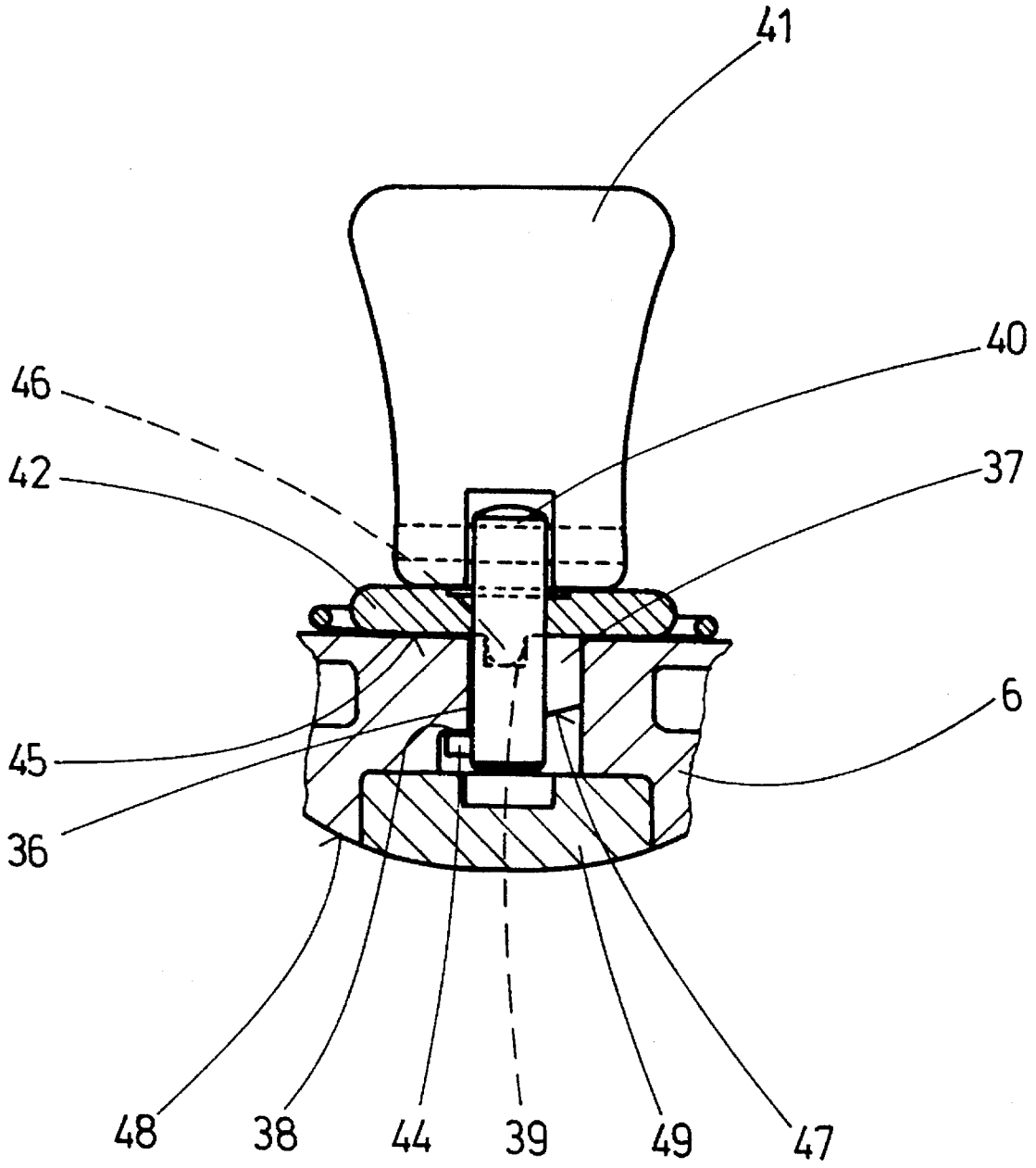

The foot-loop strap fastening is explained in the following drawings:

FIG. 1 is a top view of the surfboard;

FIGS. 2*a*–2*c* are enlarged top views of fastening bars for a starboard, portside, and sternside foot-loop strap;

FIG. 3 is a section through a starboard foot-loop strap and the associated fastening bars on line III—III of FIG. 1; and FIG. 4 is a section, transposed 90° with respect to FIG. 3, through a starboard fastening bar with a taut locking bar of a foot-loop strap.

Two fastening bars 6–8 produced as injection molded parts serve to fasten the similarly formed starboard, portside, and sternside foot-loop straps 2, 3, 4 on the upper side 5 of a surfboard 1. The fastening bars 6–8 are inserted in respective grooves 10 in the core 9 of the surfboard 1, which consists of very light polystyrene foam, and are embedded in one of the sub-bases 11 applied to the core upper surfaces made of a laminating resin such as polyurethane with a multiaxial glass cloth and outside plating or outer layer made of impact-resistant, UV-resistant plastic foil, e.g., polycarbonate FIGS. 3 and 4. The fastening bars 6–8 are close flush to the upper side 5 of the surfboard.

The foot-loop strap fastening is explained in connection with the starboard foot-loop strap 2 represented in FIGS. 3 and 4.

The foot-loop strap 2 consists of an elastic, flexible middle plate 13, two elastic, flexible external holding straps 14, 15, insertion slots 16, 17 in which the external ends 13*a*, 13*b* of the middle plate 13 penetrate from the underside 13*c* to the upper side 13*d*, a belt band 18 that is lengthwise adjustable through a buckle lock 19 that binds together both holding straps 14, 15 and the middle plate 13, and a slit padded tubing 20 made of ductile material with a zipper 21 that contains the middle plate 13 and the holding straps 14, 15.

The middle plate 13 and both holding straps 14, 15 are produced as injection-molded parts made of synthetic material.

The underside 13*c* of the middle plate 13 is sewed onto the inner side 22 of the padded tubing 20.

The belt band 18 is fed through a slot 23 in the free end 24 of one of the holding straps 14, over the upper side 25 of the same and the one end 13*a* of the middle plate 13, from above through a slot 26 in the fastening end 27 of the holding strap 14, through the insertion slot 16 in one end 13*a* of the middle plate 13 between this and the holding strap 14, over the upper side 13*d* of the middle plate 13, from above through the insertion slot 17 in the other end of 13*b* of the middle plate 13 between this and the other holding strap 15, from below through a slot 28 in the fastening end 29 of the holding strap 15 over the other end 13*b* of the middle plate 13, over the upper side 30 of the holding strap 15 and through a slot 31 in the free end 32 of the same.

The two ends 33, 34 of the belt band are connected to each other by the buckle lock 19.

The foot-loop strap 2 can tilt to a limited extent in the direction of arrows a, b around the connecting axes 35—35 between the fastening ends 27, 29 of both holding straps 14, 15.

The fastening bars 6–8 for the foot-loop straps 2–4 each contain location holes 36 at equal intervals with an insertion slot 37, an undercut 38, and an upper side positioning slot 39 to insert the locking bars 40 into with a toggle-like swivel handle 41 that are positioned so they can turn in the fastening plates 42, 43 of the holding straps 14, 15 at the ends of the foot-loop straps 2–4 and display a bolt nose 44 matched to the insertion slot 37 of the boring 36. On the underside 45 of both fastening plates 42, 43 of the foot-loop straps 2–4 noses 46 are formed which, like the locking bars 40, penetrate corresponding holes in the padded tubing 20 of the foot-loop straps 2–4.

To bring, e.g., the starboard foot-loop strap 2 in to a certain position on both starboard fastening bars 6, which are mutually arranged at intervals in the direction of the longitudinal axis of the surfboard 1 on the board upper surface 5, the noses 46 are inserted into the positioning slots 39 of the bars 6 corresponding to the desired position chosen; and in this way the belt 2 is fixed and subsequently both locking bars 40 of the belt 2 are positioned with the locking bar noses 44 in the respective location holes 36 with insertion slot 37 and with the swivel handle 41 turned 180° so that the locking bars 40 with the locking bar nose 44 interfit like a bayonet catch with the undercut 38 of the location holes 36 in both fastening bars 6. The swivel handles 41 of both locking bars 40 are retracted into the padded tubing 20, and the padded tubing is closed with the zipper 21 so that the foot-loop strap 2 is secured against unintentional loosening.

The portside foot-loop strap 3 and both sternside foot-loop straps 4 are attached to the fastening bars 7, 8 of the surfboard in the same way.

A chamfer 47 of the undercut 38 of the location holes 36 of the fastening bars 6–8 serves as a guide for the nose 44 of the locking bars 40 and makes tightening the bars possible.

The open underside 48 of the injections-molded fastening bars 6–8 is closed through a positioned strip 49.

Arranged between the location holes 36 in the fastening bars 6–8 for the locking bars 40 are screw threaded bores 50 with an upper side positioning slot 39 for fastening the foot-loop straps 2–4 in the traditional way with self-tapping screws positioned in the fastening plates 42, 43 of the straps.

The starboard, portside, and sternside fastening bars 6–8 for the respective foot-loop straps 2–4 are distinguished by the direction of the positioning slots 39 and the insertion slots 37, as can be seen in FIGS. 2*a*–2*c*.

I claim:

1. Fastening for surfboard foot-loop straps, comprising fastening bars (6–8) on an upper side (5) of a board body (1), which bars each contain location holes (36) at equal intervals with an insertion slot (37), an undercut (38), and an upper side positioning slot (39) for the insertion of locking bars (40) with a swivel handle (41) that are positioned so they can turn in fastening plates (42), (43) on the end of the foot-loop straps (2–4) and have a locking bar nose (44) matching the insertion slot (37) of the holes (36) in the fastenings bars (6–8), whereby upon turning a locking bar (40), which is placed in a location hole (36) of the fastening bars (6–8) corresponding to the desired position chosen for a foot-loop strap (2–4), the locking bar (40) interfits with a bayonet connection with the undercut (38) of the location hole (36) .

2. Foot-loop strap fastening according to claim 1, wherein noses (46) for aligning and fixing the straps (2–4), interfit in the positioning slots (39) of the respective location holes (36) of the fastening bars (6–8) formed on the underside (45) of the fastening plates (42, 43) of the foot-loop straps (2–4).

3. Foot-loop strap fastening according to claim 1, further comprising a chamfer (47) of the undercut (38) of the fastening bars (6–8) as a guide for the nose (44) of the locking bars (40).

4. Foot-loop strap fastening according to claim 1, further comprising screw threaded bores (50) arranged between the location holes (36) for the locking bars (40) in the fastening bars (6–8) with an upper side positioning slot (39) each to fasten the foot-loop straps (2–4) with tapping screws placed in the fastening plates (42, 43) of the straps (2–4).

5. Foot-loop strap fastening according to claim 1, further comprising a locking strip (49) in the underside (48) of the fastening bars (6–8).

6. Foot-loop strap fastening according to claim 1, wherein the fastening bars (6–8) are produced as injection-molded parts made of synthetic material.

* * * * *